US008419458B2

(12) United States Patent
Amaral

(10) Patent No.: US 8,419,458 B2
(45) Date of Patent: Apr. 16, 2013

(54) TUBULAR CONNECTION SYSTEM FACILITATING NONROTATING SIGNAL CONDUCTOR CONNECTION AND METHOD

(75) Inventor: Anderson da Silva Amaral, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 200 days.

(21) Appl. No.: 12/755,153

(22) Filed: Apr. 6, 2010

(65) Prior Publication Data

US 2011/0241337 A1 Oct. 6, 2011

(51) Int. Cl.
*H01R 4/50* (2006.01)

(52) U.S. Cl.
USPC ..... 439/339; 439/208; 439/638

(58) Field of Classification Search ..... 439/208, 439/210, 213, 214, 638, 339
See application file for complete search history.

(56) References Cited

U.S. PATENT DOCUMENTS

| | | | | |
|---|---|---|---|---|
| 3,994,552 | A * | 11/1976 | Selvin | 439/278 |
| 5,480,315 | A | 1/1996 | Martinelli | |
| 5,957,717 | A * | 9/1999 | Monsef et al. | 439/339 |
| 6,491,534 | B1 * | 12/2002 | Bonard et al. | 439/188 |
| 7,413,021 | B2 * | 8/2008 | Madhavan et al. | 166/380 |
| 2008/0194137 | A1 * | 8/2008 | Kuo | 439/489 |
| 2009/0084541 | A1 * | 4/2009 | Braden | 166/242.6 |

OTHER PUBLICATIONS

International Search Report and Written Opinion, Date of Mailing Sep. 29, 2001, International Application No. PCT/US2001/031400, Korean Intellecutual Property Office, International Search Report 5 pages, Written Opinion 4 pages.

McKay, G. et al. "Advanced Sand Control Completion with Permanent Monitoring," [Abstract Only] SPE Annual Technical Conference and Exhibition, Oct. 1-4, 2000, Dallas Texas.

* cited by examiner

*Primary Examiner* — Hien Vu
(74) *Attorney, Agent, or Firm* — Cantor Colburn LLP

(57) ABSTRACT

A tubular arrangement including a tubular form having an interconnection configuration on each end with one or more signal conductors disposed within the tubular form. One or more axially operative connector bodies disposed at each end of the tubular form. A coupling at one end of the tubular form capable of bridging the tubular form to another tubular and a method for building a string is included.

16 Claims, 2 Drawing Sheets

TUBULAR CONNECTION SYSTEM FACILITATING NONROTATING SIGNAL CONDUCTOR CONNECTION AND METHOD

BACKGROUND

In the drilling and completion industry, it is known that tubular members are generally run into a borehole using pin and box thread connections and that the connections are made up by rotating one tubular member relative to the adjoining one. The vernacular "turn right" generally comes from this fact and is related to the fact that tightening and therefore secure connection is assured by turning in a clockwise direction to tighten the pin and box threads. This method of configuring and operating strings running in the hole has been ubiquitously used and well tested for a great many years. The method works quite well until monitoring equipment that requires signal-bearing connections is required.

When signal-bearing connections are required, special consideration of the connection must be given. In some cases the threads must be "timed" while in other cases, a loose connection will be made on the outside of the tubular string after the threaded connections are made up. The timed threads are expensive to manufacture and potentially troublesome with respect to other engineering considerations and loose connections made up outside of the tubular string are at greater risk for damage in a borehole environment. In addition, the two noted prior art methods for effecting connections are also time consuming on the rig floor and hence are not cost efficient.

Since the downhole drilling and completion industry is likely to increase the use of signal bearing connections in the downhole environment rather than decrease them, the issues presented for prior art methods and apparatus for making such connections are amplified rather than diminished. Accordingly, the art would well receive string and signal-bearing connection alternatives that increase efficiency and protection.

SUMMARY

A tubular arrangement including a tubular form having an interconnection configuration on each end; one or more signal conductors disposed within the tubular form; one or more axially operative connector bodies disposed at each end of the tubular form; and a coupling at one end of the tubular form capable of bridging the tubular form to another tubular.

A tubular connection system including one or more tubular forms, each form having an interconnection configuration on each end; one or more signal conductors disposed within the tubular form; one or more connector bodies disposed at each end of the tubular form; and a coupling sleeve at one end of each of the one or more tubular forms, the coupling sleeve being configured to interengage one of the one or more tubular forms with another of the one or more tubular forms.

A method for building a string including axially aligning at least two of the tubular forms having an interconnection configuration on each end; one or more signal conductors disposed within the tubular form; one or more axially operative connector bodies disposed at each end of the tubular form; moving the at least two tubular forms toward one another and simultaneously connecting connector bodies of each of the at least two tubular forms; preventing rotational movement between the at least two tubular forms subsequent to connecting the connector bodies; and manipulating a coupling capable of bridging the at least two tubular forms.

BRIEF DESCRIPTION OF DRAWINGS

Referring now to the drawings wherein like elements are numbered alike in the several Figures.

DETAILED DESCRIPTION

Figure 1:
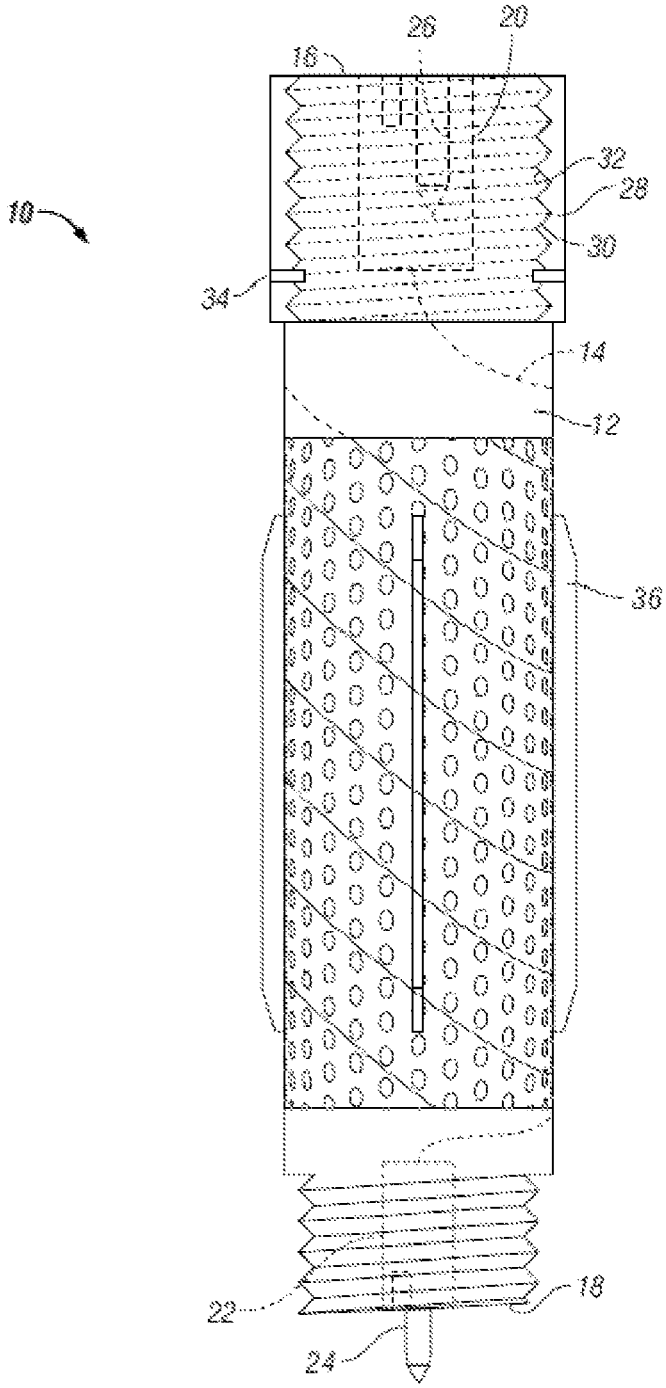
FIG. 1 is a schematic view of a joint of tubing in accordance with the disclosure hereof.

Referring to FIG. 1, a tubular connection arrangement 10 is illustrated. The arrangement 10 comprises a tubular form 12 that may be perforated as illustrated or may be solid. Further, the form 12 includes one or more signal conductors 14 provided therein and extending from one axial end 16 to a second axial end 18 of the form 12. The signal conductor(s) 14 may each be one or more actual conductive strands and may be configured to conduct optic, electric, hydraulic acoustic, etc types of signals. Further the conductor(s) 14 may be arranged helically within the form 12 or may be arranged axially, or in another convenient of otherwise desired way. The conductor (s) 14 are operably connected to one or more female connector bodies 20 and one or more male connector bodies 22, which may be arranged as all male bodies at one end of the form and female bodies at the other end of the form or may be arranged with a mix of male and female bodies at each end of the form. In any case, a male body and a female body will be axially and rotationally aligned with a male or female body as appropriate so that axial joining of two adjacent tubular forms 12 will result in signal capable connection of the male and female bodies. As can be ascertained from FIG. 1, one illustrated male connector body 22 includes a male projection 24. The male connector body 22 is positioned relative to the form 12 to cause the male projection 24 to extend beyond the end 18 of the form 12. This configuration allows for the male projection 24 to penetrate a recess 26 of one of the female connector bodies 20 when the end 18 of one form 12 is brought into axially aligned proximity with the end 16 of a next form 12. The connector bodies 20 and 22 provide signal conveying connectivity between sequential conductor(s) 14.

Importantly, the tubular connection system 10 described herein allows the connector bodies 20 and 22 to be connected upon axial motion alone and without the need for a rotational capability in the connection. This means that the arrangement 10 allows for the connections to be made while making the string up itself and that the connections can be positioned within the volume defined by the tubular form 12, hence not being disposed on an outside diameter as in the prior art and thereby subject to impact damage.

This benefit is facilitated by the configuration of interconnections of the form 12. At end 16, a coupling 28, which may be in the form of a sleeve, is provided. The sleeve 28 may be configured to threadedly interact with an elongated thread form 30 or may be configured as a partially threaded coupler with a reduced diameter aperture such that a threaded or other fastening configuration may spin on the form 12 and interconnect with an axially adjacent form 12. One type of configuration typifying that just described is a common garden hose female connector. In either case, the point is to provide for a member that is capable of interconnecting two axially adjacent forms 12 without rotating the forms 12 relative to each other. Rather, the coupling sleeve is rotatable relative to both of the axially adjacent forms 12.

Figure 2:
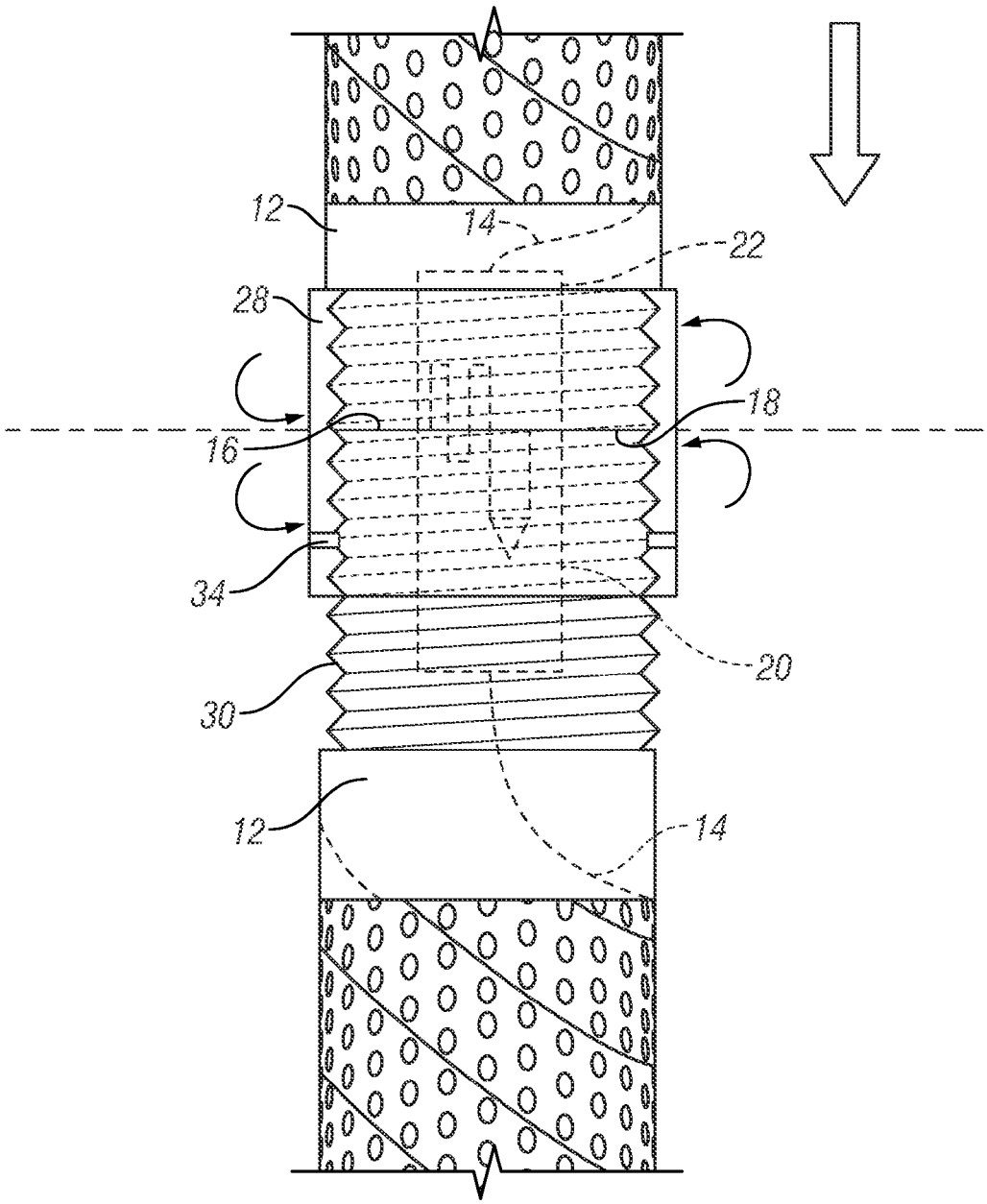
FIG. 2 is a schematic view of a portion of the joint of FIG. 1 connected to another joint of FIG. 1.

In the illustration of FIG. 1, it is evident that the elongated thread form 30 is engaged with an internal thread 32 of coupling sleeve 28. The length of the thread form 30 and coupling sleeve 28 allows the coupling sleeve to be threaded onto another form 12 as if illustrated in FIG. 2 thereby bridging the first and second tubular forms 12. While the illustrated embodiment will not draw the two tubular forms 12 axially toward each other, an alternate embodiment noted above (the garden hose female side connector configuration), will facilitate drawing the forms toward one another as well as is the case with the male and female parts of a garden hose. One or more arrestors, which may be in the form of set screws 34 are provided in coupling 28 to secure the same in the interengaged position of FIG. 2. It is to be understood that while set screws 34 are illustrated as the one or more arrestors, any means of arresting further movement of the coupling subsequent to interconnection of two forms 12 can be employed. Such means include but are not limited to welding, adhesive sealant, a lockring, etc. In each iteration, it is a consistent theme that the tubular forms 12 do not rotate relative to one another but rather are joined solely through movement of the coupling sleeve 28. Because of this condition, the connector bodies 20 and 22 never move rotationally but rather only axially. This makes signal connection faster, more reliable, less expensive both in time and configuration and better protected.

The system as noted may be continued for a long a section of tubular string is desired and then terminated in any number of known possible terminations or connections.

Referring back to FIG. 1, further illustrated is a centralizer configuration 36. Use of the optional centralizer configuration allows forces on the casing to be transmitted to the optic fibers in the arrangement 10 even if a hypothetical collapse is not directly contacting the arrangement 10. Rather the strain of a collapse on the casing is transmitted through the centralizer 36.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A tubular arrangement comprising:

a tubular form having an interconnection configuration on each end;

one or more signal conductors disposed helically within the tubular form;

one or more axially operative connector bodies disposed at each end of the tubular form; one of the connector bodies at one of the ends having a male connector body with a male conductor extended outwardly from the male connector body, and the other end having a female connector body with a female conductor disposed within the female connector body, and a coupling at one end of the tubular form, the coupling rotatable independent of the connector bodies for bridging the tubular form to another tubular without rotation of the connector bodies, wherein the coupling includes one or more arrestors.

2. A tubular arrangement as claimed in claim 1 wherein the interconnection configuration on at least one end of the tubular form is a thread.

3. A tubular arrangement as claimed in claim 1 wherein the one or more signal conductors is an optic fiber conductor.

4. A tubular arrangement as claimed in claim 1 wherein the one or more signal conductors is an electrical conductor.

5. A tubular arrangement as claimed in claim 1 wherein the one or more signal conductors is axially disposed within the tubular form.

6. A tubular arrangement as claimed in claim 1 wherein the one or more connector bodies are axially connecting connector bodies.

7. A tubular arrangement as claimed in claim 1 wherein the one or more connector bodies are male and female connecting connector bodies.

8. A tubular arrangement as claimed in claim 1 wherein the coupling is a sleeve.

9. A tubular arrangement as claimed in claim 1 wherein the coupling includes a threaded inside surface.

10. A tubular arrangement as claimed in claim 1 wherein the one or more arrestors are set screws.

11. A tubular arrangement as claimed in claim 1 wherein one of the interconnection arrangements is elongated to support a coupling having a length sufficient to bridge two such tubular forms.

12. A tubular arrangement as claimed in claim 1 wherein the arrangement further includes a centralizer.

13. A method for building a string comprising:

axially aligning at least two of the tubular forms of claim 1;

moving the at least two tubular forms toward one another and simultaneously connecting connector bodies of each of the at least two tubular forms;

preventing rotational movement between the at least two tubular forms subsequent to connecting the connector bodies; and manipulating a coupling of claim 1 to interconnect the at least two tubular forms.

14. A method for building a string as claimed in claim 13 wherein the connecting of the connector bodies is inherent in the moving of the at least two tubular forms.

15. A method for building a string as claimed in claim 13 wherein the manipulating is rotating the coupling while the at least two tubular forms are prevented from rotating relative to one another.

16. A method for building a string as claimed in claim 13 further comprising arresting the coupling subsequent to interconnecting the at least two tubular forms.

* * * * *